United States Patent [19]

Suthers

[11] 4,066,955

[45] Jan. 3, 1978

[54] HIGH VOLTAGE TRANSFORMER WINDING ASSEMBLY WITH MULTIPLE FREQUENCY TUNING

[75] Inventor: Charles E. Suthers, Chesapeake, Va.

[73] Assignee: General Electric Company, Portsmouth, Va.

[21] Appl. No.: 645,012

[22] Filed: Dec. 29, 1975

[51] Int. Cl.[2] ..... H01F 35/00

[52] U.S. Cl. ..... 363/68; 315/411; 323/48; 336/185

[58] Field of Search ..... 321/2, 8 R, 27 R, 46; 315/411; 178/DIG. 11; 336/107, 185, 192, 198, 208; 323/48, 49, 58

[56] References Cited

U.S. PATENT DOCUMENTS

| | | | |
|---|---|---|---|
| 1,340,027 | 5/1920 | Dunham | 317/15 |
| 2,799,836 | 7/1957 | Heller et al. | 336/198 |
| 3,428,929 | 2/1969 | Brown et al. | 336/198 |
| 3,750,054 | 7/1973 | Tamura et al. | 336/198 |
| 3,813,574 | 5/1974 | Sato | 336/185 |
| 3,846,666 | 11/1974 | Suzuki et al. | 315/411 |
| 3,868,538 | 2/1975 | Blanchard | 315/411 |
| 3,886,434 | 5/1975 | Schreiner | 321/27 R |
| 3,947,749 | 3/1976 | Kimura | 336/184 |

*Primary Examiner*—William H. Beha, Jr.

[57] ABSTRACT

A high voltage transformer winding assembly is disclosed which enables tuning to preferably provide a rectangular pulse output for improving voltage regulation. The winding assembly comprises a pair of winding subassemblies mounted on opposite legs of a magnetic core. Each winding subassembly is provided with a plurality of windings. The plurality of windings of the two subassemblies are interconnected to form a plurality of winding pairs. The interconnection is such as to form an a-c null or minimal a-c voltage substantially at the connection point between the windings making up a winding pair. When the start turns of the windings are interconnected to form the winding pairs the a-c null of each winding pair appears adjacent the core to reduce the likelihood of corona discharge. The plurality of winding pairs are connected in d-c series aiding by means of diodes which provide a-c isolation between the winding pairs. By selecting the spacing between windings of a subassembly and the height and width of such windings one of the resonant frequencies making up the output pulse of the winding assembly is determined in frequency and amplitude. Additionally, by selecting the spacing between subassemblies the aggregate leakage inductance and intersubassembly capacitance are altered to determine the frequency and amplitude of another of the frequencies making up the output pulse.

6 Claims, 4 Drawing Figures

HIGH VOLTAGE TRANSFORMER WINDING ASSEMBLY WITH MULTIPLE FREQUENCY TUNING

CROSS REFERENCE TO RELATED APPLICATIONS

This application describes and claims an improvement over the invention disclosed and claimed in the co-pending patent application of Eugene K. Von Fange, Edgar F. Scales and Robert F. Wood entitled "High Voltage Winding Assembly with Improved Regulation," filed the same day as this application and assigned to the assignee hereof.

BACKGROUND OF THE INVENTION

The present invention relates to a high voltage transformer winding assembly. More particularly, the present invention relates to a tunable high voltage transformer winding assembly for shaping the transformer output voltage waveform preferably in order to improve the voltage regulation thereof.

The present invention is particularly useful in the high voltage flyback transformer of a television receiver and in similar environments which require the development of a high voltage from a pulse input with a relatively moderate load current. In color television receivers, the desire for brighter pictures has placed greater demands on the cathode ray tube high voltage power supply. Increased brightness may be achieved by using a higher cathode ray tube anode voltage providing regulation of this voltage is not sacrificed. The higher anode voltage is theoretically relatively easy to produce by increasing the turns ratio of the flyback transformer. However, increasing the number of turns creates problems such as core saturation and sometimes an undesirable shift in the range of tuning. The concomitant need for good regulation presents an even more difficult problem. In addition, if the high voltage winding assembly comprises only a single winding, corona discharge problems arise when the number of turns in such a single winding is increased.

The invention described and claimed in the Von Fange et al application, referred to above, provides a means of solving these problems. It was found, in accordance with that invention, that by turning the high voltage winding assembly to predetermined resonant frequencies and by controlling the relative amplitude of the resonant frequencies, it is possible to generate a substantially rectangular high voltage output pulse with greatly improved voltage regulation. As set forth in the Von Fange et al application, a high voltage winding assembly is provided having a plurality of windings interconnected by diodes.

The selected spacing between windings and the selected height and width of the windings enable tuning of the high voltage windings assembly by adjusting stray capacitance, capacitance to space and to ground, interwinding capacitance and leakage inductance. The control of such parameters occasions a tuning of the multiple resonances of the winding assembly. While various frequencies and the amplitudes thereof are affected, control of a predominant frequency and its amplitude is primarily realized.

The present invention provides additional tuning flexibility by dividing the winding assembly into subassemblies located on different legs of the transformer core and providing for additional control of the leakage inductance and inter-subassembly capacitance by selecting the distance between the sub-assemblies. This selecting of the distance between the subassemblies affords additional tuning control over the frequencies making up the output pulse. Primarily the frequency and amplitude of a second predominant frequency are controlled.

In addition to the reduction of corona discharge problems by having a plurality of winding pairs interconnected with diodes as shown in the Von Fange et al application, the present invention provides a structure for further reducing the likelihood of corona discharge by positioning the a-c null of each winding adjacent the core. In this manner, the higher a-c voltages are spaced farther from the core reduing the a-c potential gradients since the voltage to distance ratio is decreased. This is achieved in accordance with the present invention by placing an a-c null or minimal a-c voltage on the start turns or innermost turns of each of the windings.

There are teachings in the prior art for combining two windings to form a winding pair. For example, U.S. Pat. No. 1,340,027 — Dunham discloses two layer type windings wound in opposite directions which are mounted on a common tubular support with their start windings connected together to provide terminal connections on the outer surface of the coil with the two coils producing magnetomotive forces in the same direction. U.S. Pat. No. 3,886,434 — Schreiner discloses a high voltage horizontal flyback transformer assembly in which a pair of layer wound coils are mounted on opposed legs of a single window magnetic core. Schreiner discloses that his transformer winding assembly requires no critical tuning elements and behaves essentially as an untuned system. Neither of these prior art references teach a tuned high voltage winding assembly and particularly do not teach varying the spacing between windings on different legs of a magnetic core in order to adjust the leakage inductance and capacitance of the winding assembly.

SUMMARY OF THE INVENTION

The present invention provides a tuned high voltage winding assembly comprise of two subassemblies of windings which enables multiple frequency tuning and pulse output shaping and preferably the production of a high voltage output with improved voltage regulation. The present invention, in its preferred form comprises a first and second winding subassembly mounted on a magnetic core. Each winding subassembly contains at least one winding. The distance between the winding subassemblies is selected to adjust the leakage inductance of the winding assembly in conjunction with the inter-subassembly capacitance whereby the winding assembly may be fine tuned to control the frequency and amplitude of a predominant one of the frequencies desired in the output pulse. Such fine tuning may be for the purpose of obtaining a rectangular shaped pulse output which is desirable for optimum regulation. Of course, the invention is not so limited, since it is possible to control both the frequency components of the output voltage waveform and the amplitude thereof in accordance with the teachings set forth herein to obtain other output voltage waveforms.

The spacing between the subassemblies determines the degree of flux linkage between the two subassemblies. Thus, the spacing between subassemblies may be selected to be so large that the effect of spacing on the leakage inductance is negligible, or the subassemblies may be mounted so close together that the windings of the subassemblies overlap to increase leakage inductance. By selecting the spacing between the windings subassemblies, the leakage inductance of the high voltage winding assembly may be selected to resonate with the stray capacitance of the high voltage winding assembly and with the capacitance created between the subassemblies. Since the inter-subassembly capacitance increases as the subassemblies are brought closer together and the leakage inductance decreases until the windings of the subassemblies overlap, the amplitude of the frequency created by the tuned circuit formed by the subassemblies is caused to be altered. The rates of change of the capacitance and leakage inductance are not the same so fine tuning (minor shift in frequency) is realized.

In a preferred embodiment of the present invention, the start leads or innermost turns of the windings on two subassemblies are connected together to form winding pairs. With the windings of each pair being symmetrical in construction, for example, but not by way of limitation, having the same height, width and number of turns, an a-c null is located approximately at the connection point and on the start lead or innermost turns of the two windings which comprise the pair. This places the a-c null in the area of the winding which is closest to the core. Since the core is usually at ground potential, a d-c voltage or minimal a-c voltage is placed adjacent the ground plane of the transformer and the maximum a-c potential on each winding is at the point farthest from the core on the outermost turns of the winding.

It should be understood that although winding pairs are described as being formed by the connection of the start lead of a winding of one winding subassembly with the start lead of a winding of the other winding subassembly and the use of a diode to interconnect winding pairs at the finish leads thereof, it is also possible to achieve pulse shaping by control of leakage inductance when winding pairs are formed by the interconnection of finish leads and the use of diodes interconnecting winding pairs at the start leads thereof.

By interconnecting the start turns of the windings comprising a winding pair, an a-c null is created between the windings of that pair. This a-c null eliminates the need for a diode at that location to provide a-c isolation. This results in a decrease in the number of required diodes for a predetermined number of windings. In this way, the present invention reduces the cost of the high voltage winding assembly.

The elimination of the requirement of a diode for a-c isolation at every a-c null point usually, although not necessarily, results in $n/2$ diodes being required for $n$ windings. Since the number of diodes for a predetermined number of windings is decreased, more windings, each having smaller diameter and fewer turns, may be used to produce the required high voltage without incurring excessive diode cost. The voltage induced in each turn of a winding is substantially constant independent of diameter, at least for the diameter variations presently under consideration. Therefore, by using smaller diameter turns, made possible by the multiple windings making up the winding assembly of the present invention, the circumference of each turn is reduced thereby reducing the amount of copper wire which is required to produce that turn. Thus saving can be realized by replacing large diameter outer turns by smaller diameter turns in other windings. This results in a substantial reduction in the amount of copper wire required for the high voltage winding assembly with the resulting reduction in cost.

One advantage of the present invention is that it provides a means of tuning the high voltage winding assembly to predetermined resonant frequencies of selected amplitude by control of the leakage inductance and the capacitance of the high voltage winding assembly.

Another advantage is the provision of a tuning control for shaping the output pulse of the high voltage winding assembly of a transformer by adjustment of the spacing between separate winding subassemblies of said high voltage winding assembly.

Another advantage of the present invention is that it provides a means of producing an a-c null on the innermost turns of each winding thereby placing a minimal a-c voltage adjacent to the core.

Another advantage of the present invention is that it provides a-c isolation between each of the windings with fewer diodes due to the fact that an a-c null may be generated between two windings comprising a winding pair without requiring diode means between the windings of the winding pair.

Another advantage of the present invention is that it provides economies by reducing the amount of the copper wire required to produce a predetermined voltage output.

BRIEF DESCRIPTION OF THE DRAWINGS

These and other advantages of the present invention will be more readily understood from the following detailed description of preferred embodiments of the invention taken in conjunction with the drawings in which.

DETAILED DESCRIPTION OF THE PREFERRED EMBODIMENTS

Figure 1:
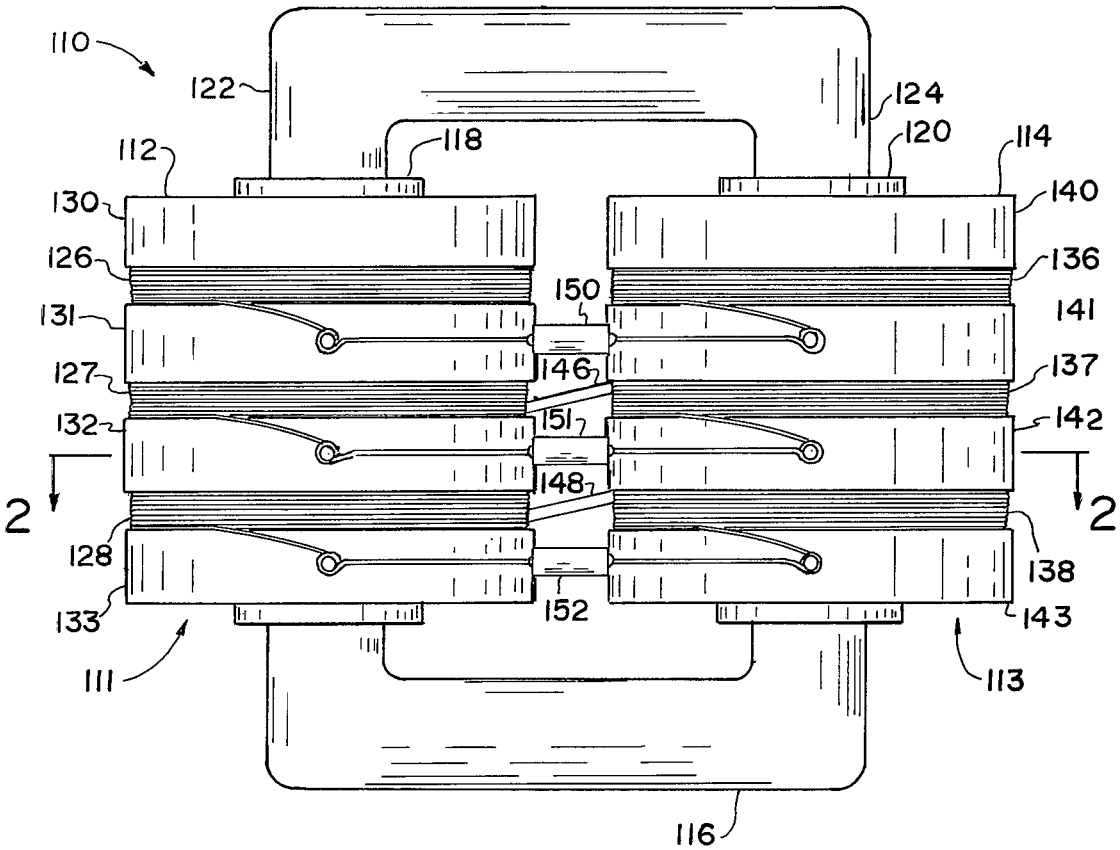
FIG. 1 is a side elevation view of a high voltage transformer winding in accordance with the present invention.
Figure 2:
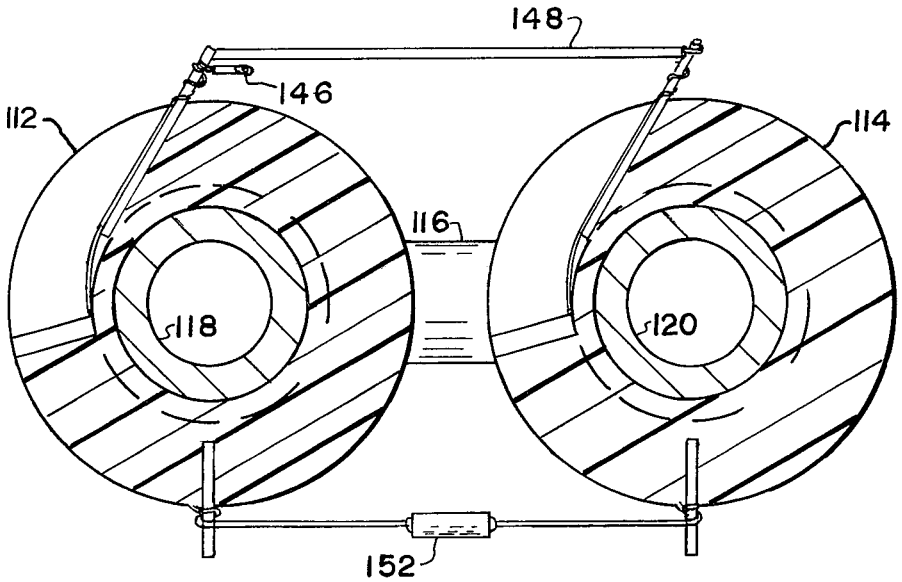
FIG. 2 is a cross sectional view taken along line 2—2 of FIG. 1.
Figure 3:
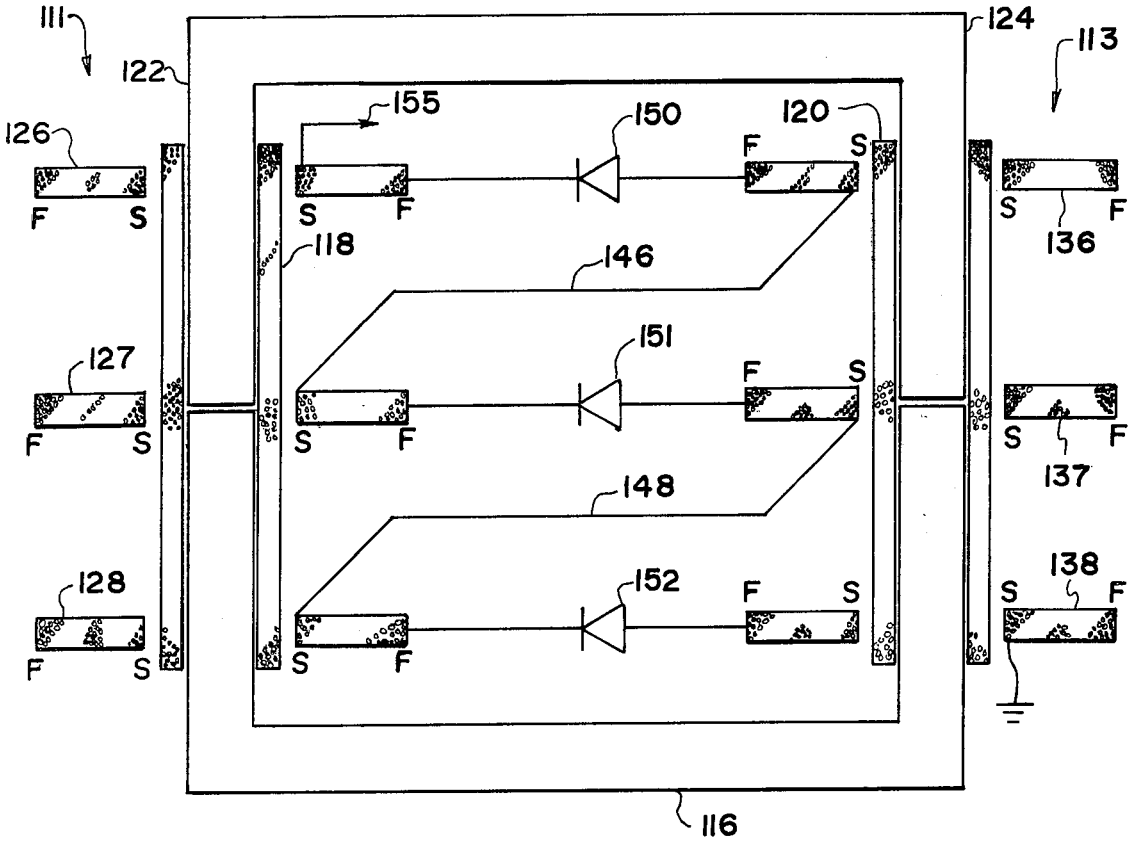
FIG. 3 is a diagram of a high voltage transformer winding assembly in accordance with the present invention.

Referring now to the drawings in detail, wherein like numerals indicate like elements, there is shown in FIGS. 1 and 2 a high voltage winding assembly 110, which is illustrated in diagramatic form in FIG. 3. It may be helpful to refer to FIGS. 1, 2 and 3 taken together. High voltage winding assembly 110 is comprised of winding subassemblies 111 and 113 mounted on core means 116. Winding subassembly 111 is comprised of a coil form means 112 having partition members 130, 131, 132 and 133 which form slots into which windings 126, 127 and 128 are wound. A second winding subassembly 113 is comprised of a coil form means 114 having partition members 140–143 which form slots into which windings 136, 137 and 138 are wound.

Core means 116 is provided with a primary winding, which may be a combined primary and secondary winding, split into two parts or sections 118 and 120. Section 118 of the primary winding is mounted over core leg 122 and inside the inner diameter of coil form means 12. Section 120 of the primary winding is mounted over core leg 124 and inside the inner diameter of coil form means 114. Sections 118 and 120 of the primary winding are connected to provide additive flux in core means 116. The primary sections 118 and 120 may preferably be equally divided on core legs 122 and 124. However, it is not necessary that the primary winding sections 118 and 120 be equally divided and in fact the transformer may be operated satisfactorily with wide deviations from an equal division.

Although equal division of the primary winding as illustrated may be the preferred embodiment, it is not intended to be limiting, and a single primary winding or any suitable means for producing the magnetic flux in core means 116 in response to an input pulse may be used.

FIG. 3 is a diagram of the structure illustrating the core means 116, the various windings and their interconnections. "S" indicates the start turns or innermost turns of each winding and "F" indicates the finish or outermost turns of each winding. The windings of subassemblies 111 and 113 are connected in winding pairs. Each winding pair is comprised of a winding from each subassembly. The windings in the winding pairs are preferably connected together by means of a conductor at their start leads or start turns. The winding pairs are d-c connected together by means of diodes which provide a-c isolation between the winding pairs.

In a preferred embodiment illustrated in the drawings, windings 128 and 137 of subassemblies 111 and 113 respectively, are connected together at their start leads S by means of conductor 148 to form a winding pair. The start lead S of winding 127 of subassembly 111 which is mounted on core leg 122, may be connected to the start lead S of winding 136 of subassembly 113, which is mounted on opposed core leg 124. Diode 151 is connected between the finish leads of winding 127 and winding 137 providing a-c isolation between the first mentioned winding pair comprised of windings 128 and 137 and the second mentioned winding pair comprised of windings 127 and 136. Diode 150 is connected between the finish leads F of windings 136 and 126 and diode 152 is connected between the finish leads F of windings 128 and 138 providing a-c isolation at these points. The d-c output voltage of the high voltage transformer assembly is provided on lead 155. Electrically, windings 126 and 138 may be considered to comprise a winding pair with an a-c null on the start turns S of both windings. The start leads S of windings 126 and 138 are connected together through the load circuit.

In accordance with the teachings in the aforementioned Von Fange et al application, the height and width of windings 126–128 and 136–138 may be selected to produce a predetermined voltage distribution along the height of each of the windings. Adjustments of height and width of the windings also affect the stray capacitance of the windings. By selecting the height and width of the windings to be uniform, symmetrical voltage distributions may be generated along the height of adjacent windings. Such symmetrical voltage distribution reduces the effects of interwinding capacitance. The selection of the proper value of stray capacitance is one means that contributes to the tuning of the high voltage winding assembly. The spacing between windings 126, 127 and 128 and the spacing between windings 136, 137 and 138 is selected as one means to adjust the leakage inductance of the winding subassemblies and therefore the leakage inductance of the winding assembly.

The height, width and number of turns of the windings of each winding pair may be selected to be symmetrical. By providing symmetrical windings in each winding pair, equal voltages of opposite polarity, as measured from the conductor connecting the two windings which comprise the pair, are generated across the windings. In other words, at a particular instant of time, with the start leads connected together, the finish turn of one winding of the winding pair will be at a positive peak potential and the finish turn of the other winding of the winding pair will be at a negative peak potential. The a-c potentials developed across the two windings are of series-aiding polarities with an a-c null being generated at or near the connection point between the two windings, i.e. on conductors 146 and 148. Conductor 146 is at essentially the same potential as the start turns of windings 127 and 136. Conductor 148 is at essentially the same potential as the start turns of windings 128 and 137. The start turns of winding 138 are at an a-c null since they are connected to ground and the start turn of winding 126 is the d-c output, on lead 155, which is basically at an a-c null. This structural arrangement of the windings produces an a-c null in the windings at the point at or near the core means 116 which is usually at ground potential. The peak a-c voltages that exist in the windings are on the finish turns of each of the windings 126–128 and 136–138. Since the finish turns are farthest from core means 116, the ratio of peak a-c voltage to distance from the core is reduced resulting in a reduced a-c potential gradient thereby lowering the likelihood of corona discharge. The reduction of corona discharge by positioning the a-c null adjacent the core is in addition to the reduction in corona discharge problems by reason of the rectification of a-c voltages developed across the winding pairs. The output of each winding pair is a d-c voltage which is summed in the series-aiding connections to provide the high voltage d-c output on lead 155.

It may be noted that each of the windings of the high voltage transformer winding assembly is at an a-c null substantially at the point of interconnection with the other windings. This is accomplished by using only three diodes for six windings. Only two diodes would be necessary to provide a-c isolation for four windings.

By selecting the spacing between subassemblies 111 and 113, the leakage inductance of the winding assembly may be varied or adjusted to fine tune the winding assembly to predetermined resonant frequencies. An understanding of this concept may be enhanced by referring to FIG. 4 which is a simplified embodiment of the present invention in which a subassembly 160 is comprised of a single winding 162 mounted over section 164 of a primary winding which is mounted over core means 166. A second winding subassembly 170 comprised of a single winding 172 mounted over section 174 of a primary winding which is mounted on opposed core leg 178 of core 166. The distance between the centers of opposed core legs 168 and 178 is represented by the spacing distance D. The spacing distance D also represents the distance between the centers of winding subassemblies 160 and 170.

Figure 4:
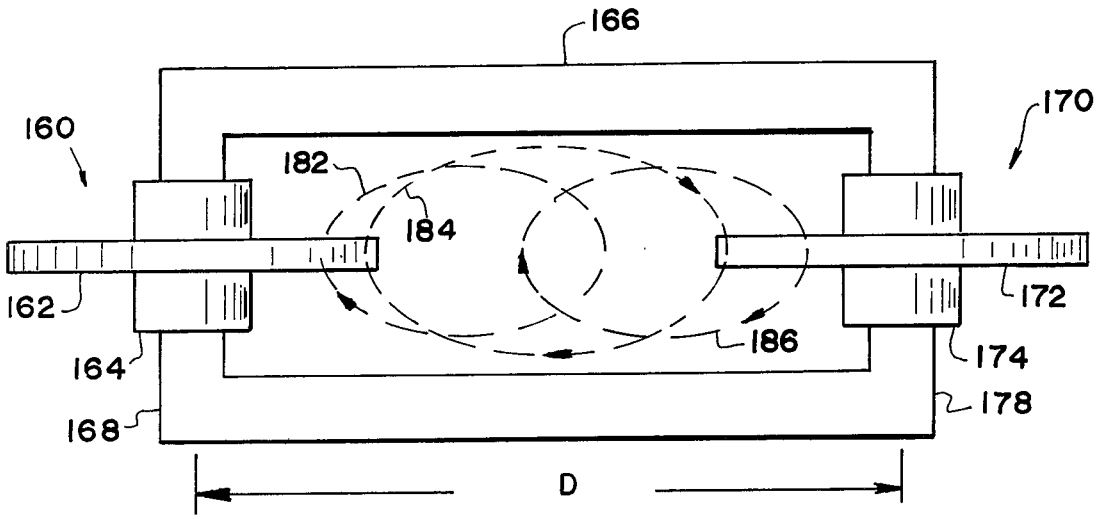
FIG. 4 is a diagram of a simplified embodiment of a high voltage winding assembly in accordance with the present invention illustrating various magnetic lines of flux.

The magnetic coupling between section 164 of the primary winding and winding 162 induces currents into winding 162. The currents in turn generate magnetic lines of flux, two of which are illustrated at 182 and 184. The magnetic coupling between section 174 of the primary winding and winding 172 induces currents in winding 172. These currents in turn generate magnetic flux lines, one of which is illustrated at 186. As indicated in FIG. 4, the magnetic flux lines interact to cause magnetic flux cancellation which tends to increase as the subassemblies are brought closer together. In other words, flux loss is reduced with the result that the leakage inductance of the winding assembly is reduced. Since at the same time the leakage inductance is being reduced, the inter-subassembly capacitance is increased, the resonant circuit formed by this inductance and capacitance is trading off inductance for capacitance and the amplitude of the frequency determined by the circuit is caused to change. Since the capacitance and inductance do not change at the same rate, fine tuning of the selected frequency (a small change in frequency) is also realized.

If the spacing between windings subassemblies 160 and 170 are selected so that winding 162 and winding 172 overlap or interleave each other, the magnetic lines of flux generated by the windings 162 and 172 tend to aid or increase flux linkage so that an increase in the leakage inductance is realized. Although this is generally not desirable, in certain cases, it may be desirable to increase the leakage inductance to effectuate proper tuning.

Although the tuning effects of varying the spacing between winding subassemblies has been explained in connection with the simplified embodiment of FIG. 4, it is understood that the same principles apply with respect to the embodiments comprising a plurality of winding pairs. The magnetic flux linkages between the windings of the two subassemblies would be additive, or possibly subtractive, in the same manner as described with respect to FIG. 4. As discussed above, the windings of the two assemblies may be interleaved to increase the leakage inductance. Furthermore, it is not required that the windings be mounted directly across from each other on the opposed legs of the core, but may be moved in either direction, subject to the dimensions of the core. It will also be apparent to those skilled in the art that various other groupings may be made of windings of the two subassemblies to form the winding pairs, constrained by each winding pair being comprised of one winding from each of the two winding subassemblies. It will also be apparent that the subassemblies may be mounted on different portions of the core means in order to produce various leakage inductance effects. For example, one winding subassembly may be mounted on the top or bottom section of a core and the other mounted on the left or right section of the core. In other words, the two winding subassemblies could be mounted in any two of the four quadrants in which the core exists. Alternately, the core may be toroidal shaped with the winding subassemblies in any two of the four quadrants. However, preferably the subassemblies are mounted on opposed core legs to take advantage of the preferred magnetic coupling as described above.

In view of the foregoing, the present invention may be embodied in other specific forms without departing from the spirit or essential attributes thereof and, accordingly, reference should be made to the appended claims, rather than to the foregoing specification as indicative of the scope of the invention.

I claim:

1. In a television receiver, a transformer for providing substantially rectangular shaped high-voltage output pulses to the cathode ray tube of said television receiver in response to input pulses, said transformer comprising:

a magnetic core having at least a pair of legs, a primary winding mounted on at least one of said legs and responsive to said input pulses to produce magnetic flux in said core, a high voltage winding assembly comprised of first and second subassemblies of windings, each subassembly being mounted on one of the legs of said core, means interconnecting the windings of said first and second subassemblies to form a plurality of winding pairs, each winding pair being comprised of a winding of said first subassembly and a winding of said second subassembly, the interconnection being such that said windings are connected in series aiding relationship, said pair of legs and the subassemblies mounted thereon being spaced from each other by a distance selected to enhance the leakage inductance to produce substantially rectangular output pulses from said high voltage winding assembly.

2. The transformer recited in claim 1 wherein said primary winding comprises first and second sections each section being mounted on one of the legs of said core and the first and second subassemblies being mounted over said first and second sections, respectively.

3. The transformer recited in claim 1 wherein said means interconnecting said windings include conductor means interconnecting windings of said first and second subassemblies to form said winding pairs and diodes interconnecting said winding pairs in series aiding relationship.

4. The transformer recited in claim 3 wherein said electrical conductor interconnects the start turns of each of the windings of each winding pair and the windings of each winding pair are wound to be symmetrical to form an a-c null substantially at said start turns.

5. In a television receiver, a transformer for generating high voltage output pulses for the cathode ray tube of said television receiver in response to input pulses, said transformer comprising:

a magnetic core having at least a pair of legs, a primary winding mounted on at least one of said legs and responsive to said input pulses to produce magnetic flux in said core, a high voltage winding assembly comprised of first and second subassemblies of windings, each subassembly being mounted on one of the legs of said core, electrical connection means interconnecting the windings of said first and second subassemblies to form a plurality of winding pairs, each winding pair being comprised of a winding of said first subassembly and a winding of said second subassembly, diode means interconnecting said winding pairs in series aiding relationship and providing a-c isolation between winding pairs, the height and width of each of said windings and the spacing between windings within a subassembly being selected in conjunction with the spacing between said legs and subassemblies mounted thereon to realize a predetermined shape for said output pulses.

6. The transformer recited in claim 5 wherein said electrical connection means comprises electrical conductors interconnecting the start turns of the windings comprising each winding pair and the windings of each winding pair being wound symmetrical to form an a-c null substantially at said start turns.

* * * * *